US008028790B2

(12) United States Patent
Roberson

(10) Patent No.: US 8,028,790 B2
(45) Date of Patent: Oct. 4, 2011

(54) SOUND PROJECTION DEVICE ATTACHABLE TO A USER WHEN NOT IN USE

(76) Inventor: Andre Roberson, Houston, TX (US)

( * ) Notice: Subject to any disclaimer, the term of this patent is extended or adjusted under 35 U.S.C. 154(b) by 0 days.

(21) Appl. No.: 12/546,747

(22) Filed: Aug. 25, 2009

(65) Prior Publication Data

US 2010/0193281 A1 Aug. 5, 2010

Related U.S. Application Data

(60) Provisional application No. 61/148,572, filed on Jan. 30, 2009.

(51) Int. Cl.
*G10K 11/00* (2006.01)

(52) U.S. Cl. ..... 181/22; 181/178; 181/180; 181/0.5; 2/209.11

(58) Field of Classification Search ..... 181/22, 181/0.5, 178, 180; 2/209.11
See application file for complete search history.

(56) References Cited

U.S. PATENT DOCUMENTS

| | | | | |
|---|---|---|---|---|
| 4,249,267 | A * | 2/1981 | Voss | 2/69 |
| 4,613,012 | A * | 9/1986 | Mueller, III | 181/178 |
| 4,703,829 | A * | 11/1987 | Hardt | 181/178 |
| 5,704,067 | A * | 1/1998 | Brady | 2/170 |
| 6,412,116 | B1 * | 7/2002 | Clark | 2/129 |
| 6,810,529 | B1 * | 11/2004 | Reilly et al. | 2/69 |
| 6,889,797 | B2 * | 5/2005 | Cowgill et al. | 181/178 |
| 2003/0019008 | A1 * | 1/2003 | Prather | 2/69 |

* cited by examiner

*Primary Examiner* — Forrest M Phillips
(74) *Attorney, Agent, or Firm* — Darcell Walker

(57) ABSTRACT

A megaphone comprises a rigid but bendable material with a tapered shape. When the material is folded, the produced megaphone has a small opening at one end and a larger opening at the other end. The megaphone has edges that form an opening along the side such that when pressure is applied to the edges the opening expands allowing the megaphone to be positioned on a person's arm or leg. Once positioned on the arm of leg the rigidity of the material causes the megaphone return to its original cone shape. The megaphone can enclose around a user's arm or leg for storage purposes during an event. Information can be displayed on the surface of the megaphone. The megaphone of the present invention can be folded and unfolded.

14 Claims, 4 Drawing Sheets

SOUND PROJECTION DEVICE ATTACHABLE TO A USER WHEN NOT IN USE

CROSS-REFERENCE TO RELATED APPLICATIONS

This application is related to and claims priority from provisional patent application No. 61/148,572, filed on Jan. 30, 2009 the contents of which are incorporated herein by reference.

FIELD OF THE INVENTION

The present invention relates to a device used to support at various events and in particular to a device through which one can make audible sounds such as yelling and which one can attach to his or her person when not yelling through the device.

BACKGROUND OF THE INVENTION

A megaphone, speaking-trumpet, bullhorn, blowhorn or loud hailer is a portable, usually hand-held, funnel cone-shaped device whose application is to amplify a person's voice towards a targeted direction. This is accomplished by channeling the sound through a funnel, which also serves to match the acoustic impedance of the voice cords to the air. The natural human voice tends to spread evenly in all directions, whereas when it is sent through a megaphone, the sound is concentrated in a given direction and the coupling of its energy to the air optimised. The trade-off is that if a listener is to the side, it is more difficult to hear what is being said. An electronic megaphone amplifies sound to a higher decibel level. It consists of a microphone an amplifier and a loudspeaker.

Megaphones have been used for many years to project the voice of the user. Many megaphones have a generally conically shaped horn configuration, with a relatively small mouth opening which flares outwardly to the outermost broadcast end. Although various powered-type megaphones have been developed, the simplest megaphone merely relies on the horn effect to transmit the sound of the user outwardly from the user. At public sports events, the spectators show their approval/disapproval of occurrences in play actions on a more or less continuous basis. The "home" field affect is well recognized in sporting events, wherein the home crowd which is generally the largest percentage of the spectators, can affect the outcome by verbally "getting into" the game. Thus, the cheering by the home spectators can psychologically affect the attitude and play of the home team. At such spectator events, one may see spectators forming their programs into a horn shaped configuration to more fully project their voice with that of the other spectators.

When people attend various events and in particular athletic events people show their support by making noise for their teams. One thing people do is roll up pieces of paper or cup their hands together to try and project their voices toward the field of play. Some times this approach does not work very well as the people that cup their hands together didn't accomplish much and the individuals that use rolled up paper ended up with a mess that they occasionally pick up. Sometimes individuals keep the rolled up paper in their hands tightly rolled up to hold on to it and not get it dirty by laying it on the ground or bleachers. There remains a need for a device that people can used to show support for their teams that can be conveniently stored when not being used.

Various designs of megaphones are used today. One design described in U.S. Pat. No. D559,830 to Lintern is a foldable megaphone. This mega contains handles at each edge. It appears that a person uses the handles to fold the megaphone and bring the ends of the megaphone together.

U.S. Pat. No. 6,940,984 to Carpenter describes a megaphone having: a microphone assembly including means for attachment to a user adjacent to the user's mouth for hands-free operation; a body pack provided with means for attachment to the users body and incorporating an output horn; and a flexible cable connecting the microphone assembly to the body pack.

U.S. Pat. No. 4,703,829 to Hardt describes a collapsible and portable megaphone formed from a self-supporting flexible plastic sheet. The sheet is wrapped with overlapping side edges to form a horn shaped member. The overlapping edges are releasably interlocked by edge slots and interconnecting edge arms. A separate mouthpiece has a tube, which telescopes into the narrow mouth end of the horn and has an outer shaped end for coupling to the user's lips. The plastic sheet may be rolled into a compact tubular roll. The mouthpiece is placed over the roll to maintain the rolled configuration for storage and transport. The horn sheets can be readily mass-produced by stamping and the mouthpiece by molding.

United States Patent Application 20060266579 to Stern et al. describes an inflatable acoustic megaphone that can be inflated into a substantially frustoconical shape for use and deflated and folded into a relatively small space when not in use, optionally providing text and/or graphics on its surface that can be used for advertising or promotions.

Even though there are many designs for the megaphone, there still remains a need for a megaphone that is storable on the arm of the person using the megaphone.

SUMMARY OF THE INVENTION

The present invention comprises tapered ends to add comfort on the users mouth/lips during use as a sound projection device and the contour aids in comfort when the user stores the device on his/her arm. Each end of the tapered device comprises an opening. The opening at the smaller end of the tapered device fits against the user's mouth to allow sounds from the user to enter the device. The larger tapered end channels the sounds toward the participants of the event. The cone design of the present invention allows the units to be easily stacked together. In addition, the present invention has a surface area that allows the user to have a team, expression or viewpoint displayed and made known to those around him/her.

An embodiment of the present also has the capability to expand the cone shape of the device in order to allow a user to position the device around an arm or leg when the device is not in use. In this embodiment, the device can comprises a rigid material having a generally cone shape. The material has two edges that come together to form the shape. The material is rigid such that it holds its' shape. However, the material also has some flexibility that allows the user to apply pressure and move the edges apart in order for a use to position the device around his or her arm or leg. After positioning the device on the user's body, the rigidity of the device will cause the edges of the device to come back together and return it to its' original shape and thereby enclose around the user's arm or leg. When the device encloses around the arm or leg of the user, the rigidity of the device will secure it on the user.

The present invention can be used for all types of events where the user would like to be heard and express a view without being burdened with the need to hold on to the device when not in use.

DESCRIPTION OF THE INVENTION

Currently, fans cup the hands together or use vocal projection devices that require the user to hold on to the device to prevent loosing or soiling it when it is not in use. The present invention is a sound projection device that is to place to a user's mouth in order to project sounds from the user toward participants in an event. The present invention is a device that provides for more expressive interaction at sporting events, political events, demonstrations and other events. The present invention is a sound projection device that channels sounds from a person out into the atmosphere. This sound projection device has tapered sides which causes the device to form a generally cone-type shape. This shape allows easy storage of the device on the user's arm when the person is not using the device for sound projection. The device of the present invention can have a contour fit to conveniently fit on the arm of a person. To facilitate the contoured fit, the dimensions of the sheet of material from which the projection device is formed must be in a range that will provide a secure and comfortable fit of the device on the user's arm or leg. Devices that are too large would not securely fit around a user's arm or leg. Devices formed of material with too small dimensions will not fit around a user's arm of leg. The device also has surfaces that allow the user to display visual messages. Using two units, the user can clap the units together to create noise to support or distract participants in an event.

Figure 1:
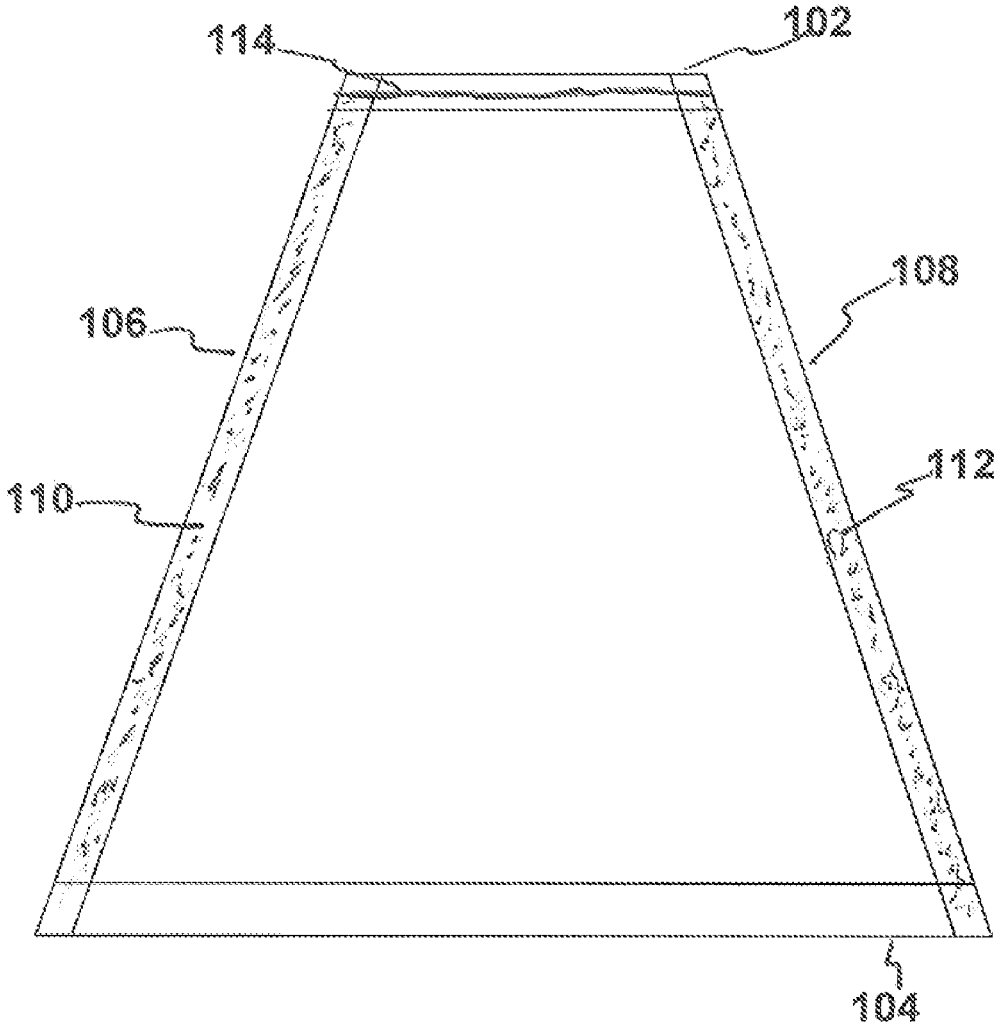
FIG. 1 is an open and unfolded view of the device of the present invention.

FIG. 1 shows an open configuration of the present invention. As shown, the invention has a front end 102 and a back end 104. The front end 102 is smaller than the back end 104. The front end 102 will form a smaller opening through the person will yell. The back end 104 is longer than the front end 102. The front end should be of a length such that when present invention is positioned on a user's arm, the front end is positioned in the area of the user's wrist. To facilitate a comfortable and secure fit a length of the front end could be in the range of 9 inches to 13 inches. With length range for the front end, when the present invention is folded, the front would form an inner circumference in the range of 9 inches to 13 inches. When folded, the back end 104 will serve as the end through which sounds made by a person go into the atmosphere. The lengths for the back can vary and depend on the amount of flare the device will have. The more flare in the device the greater the length and circumference of the back end. A general range of length for the back end could be 13 inches to 17 inches. With devices that will fit around a user's leg, the dimensions for both the front end and the back end will vary. Typical dimensions for the front end of a device to fit around a user's ankle range from 10 inches to 14 inches. Typical dimensions for the back end to fit around a user's calf/leg would be in the range of 16 to 20 inches. The amount of flare or taper is directly related to the difference between the lengths of the front side and back side of the device of the present invention.

FIG. 1 also shows two side edges 106 and 108. These edges can also contain strips of magnetic material 110 and 112 that secure these ends together to form the megaphone shape of the present invention. These magnetic strips can vary in width. The material of the present convention has a rigid character. When the material is molded into a cone shape of the present invention, this material is resilient will retain or resume that shape. The edges 106 and 108 come together, but are not permanently attached. Because the edges can be separated, pressure can be applied to pull them apart and create an opening on the side of the device to allow the user to position the device around their arm or leg.

In another embodiment, the present invention comprises a sheet of generally rigid material having a surface with opposite ends. As in FIG. 1, the front end 102 is smaller than the back end 104. The front end 102 will form a smaller opening through the person will yell. The back end 104 is longer than the front end 102. The front end should be of a length such that when present invention is positioned on a user's arm, the front end is positioned in the area of the user's wrist. The material has a coned and tapered shape from the front end to the back end. The material sheet edges 106 and 108 meet to create the cone shape. As pressure is applied to the edges, the edges will separate creating an opening through which the user can insert their arm when storing the device. When the user arm is in the device and the pressure stops, the rigid character of the device will cause the edges to come together surrounding the user's arm in the device.

Figure 2:
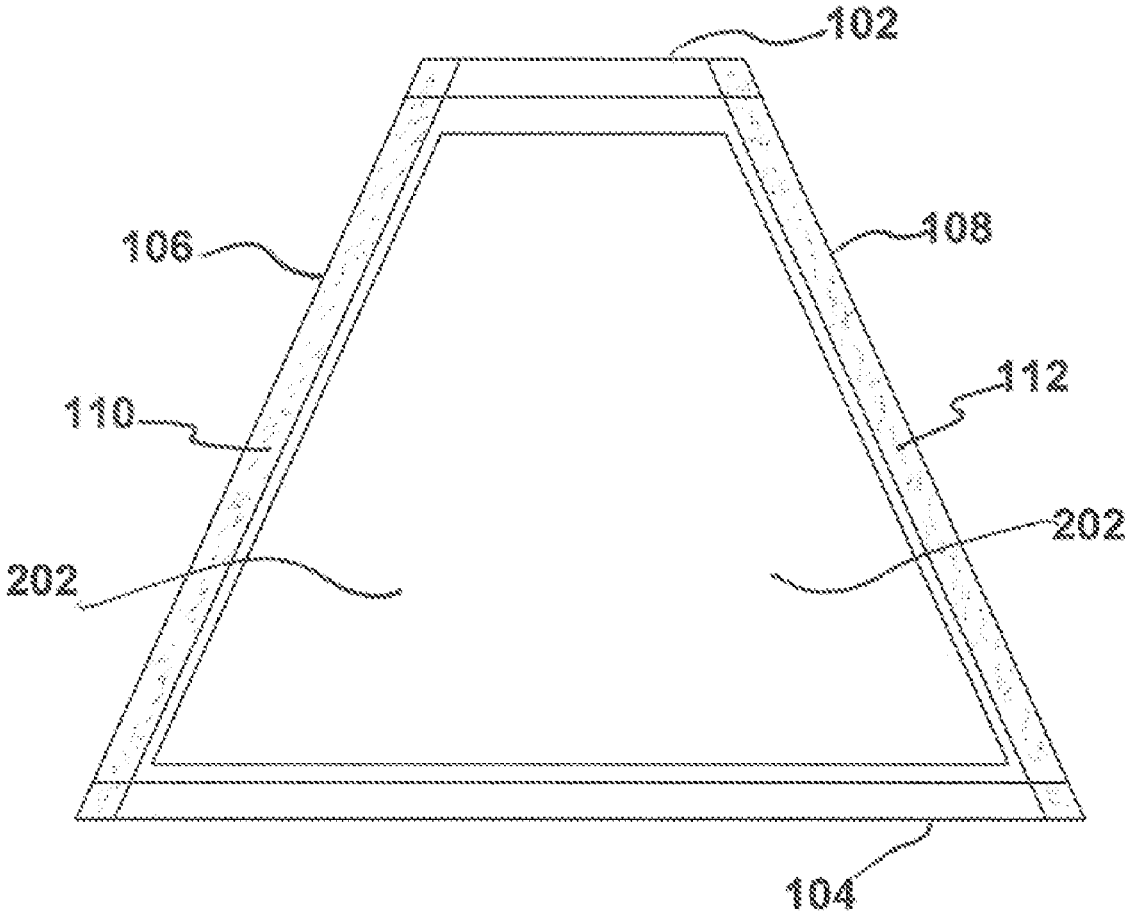
FIG. 2 is an open and unfolded view of the device of the present invention showing a transparent compartment.

Referring to FIG. 2 shown is an open configuration of the invention with a transparent compartment 202. The transparent compartment 202 is formed across a surface of the device. This compartment can comprise a clear plastic sheet material secured to the surface. The plastic sheet can be secured to the device surface such that an opening on one edge of the plastic sheet causes plastic sheet and device surface to form a pocket. Within the pocket information such as a school logo can be displayed in the device. The compartment formed on the device can vary in dimensions and can extend to the adhesive edges on each side of the device.

Figure 3:
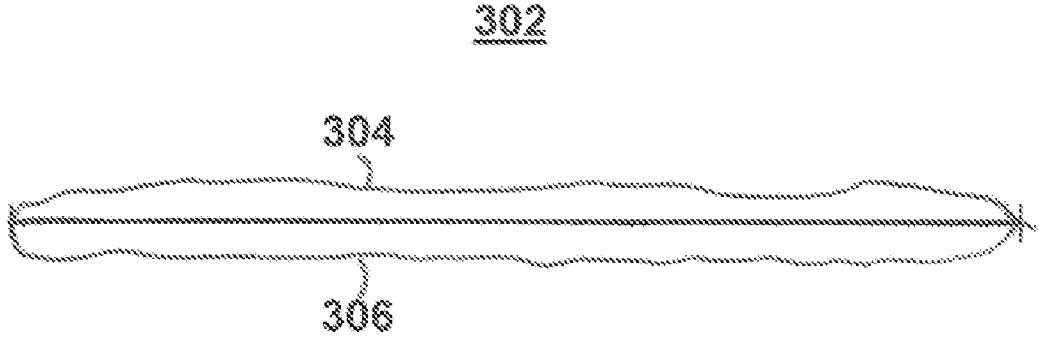
FIG. 3 is side view of the magnetic edges of the present invention.

FIG. 3 shows the device 302 with the side edges 304 and 306 coming together. In this configuration, the two side edges may or may not actually touch. However, they sufficiently close to enclose the user's arm.

Figure 4:
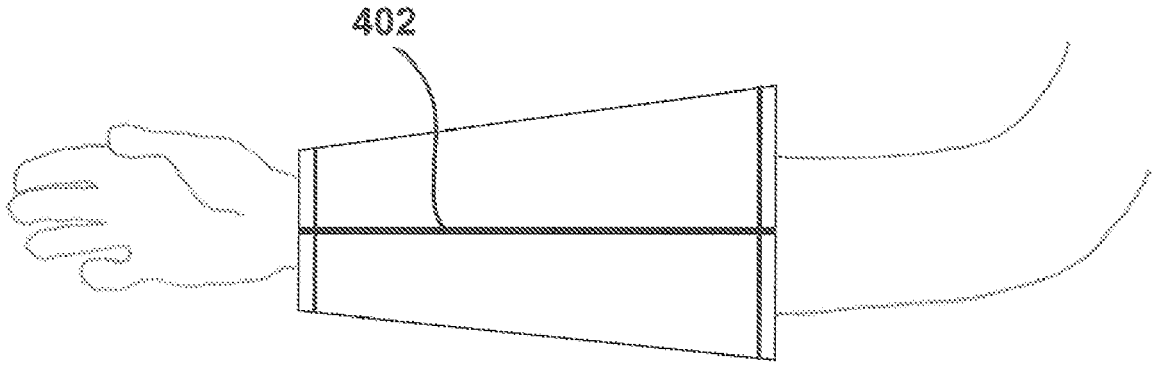
FIG. 4 is a view of the present invention folded and closed around a person's arm showing the seal of the edges.
Figure 5:
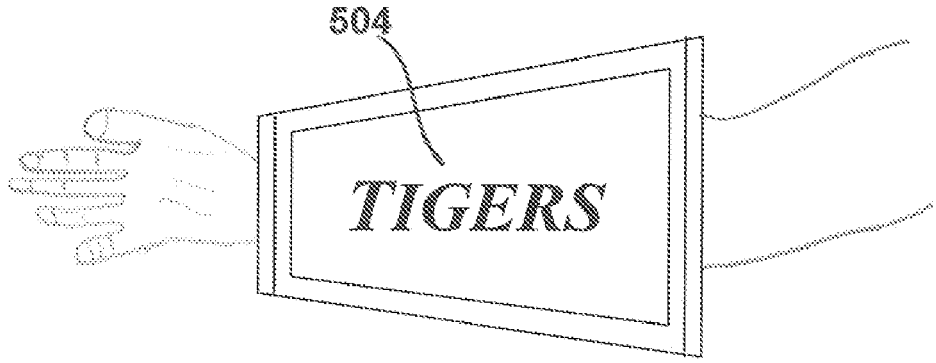
FIG. 5 is a view of the present invention folded and closed around a person's arm showing the transparent compartment.

FIG. 4 is a closed view of the device of the present invention showing the seal 402 of the edges 106 and 108. The edges are attached to each other by magnetic force and attraction of the magnetic materials 110 and 112. When the device is secured to the person's arm for storage, the edges should preferably be on the inner side of the person's arm. This position will facilitate an optimal display of the information in the compartment or printed on the device. FIG. 5 shows the device in a closed and folded position with a logo 504 being displayed through the transparent compartment or printed on the device.

In an alternate embodiment of the present invention, there can be a lining material positioned on the one side of the device. This lining would serve to protect the user from the elements such as cold weather. When not using the device to yell through, the device could be used to warm the user's arm.

In another alternate embodiment of the present invention, the device could have transparent compartments on both sides of the device. In this embodiment, the device could be reversible and would have the capability to display images on either side. The user would configure and close the device based on the particular image that the user wanted to display.

In another alternate embodiment of the present invention, the transparent compartments can have airtight seals, which would provide the capability to inflate the compartments.

Another alternate embodiment can have multiple transparent compartments that can be attached to the device.

Figure 6:
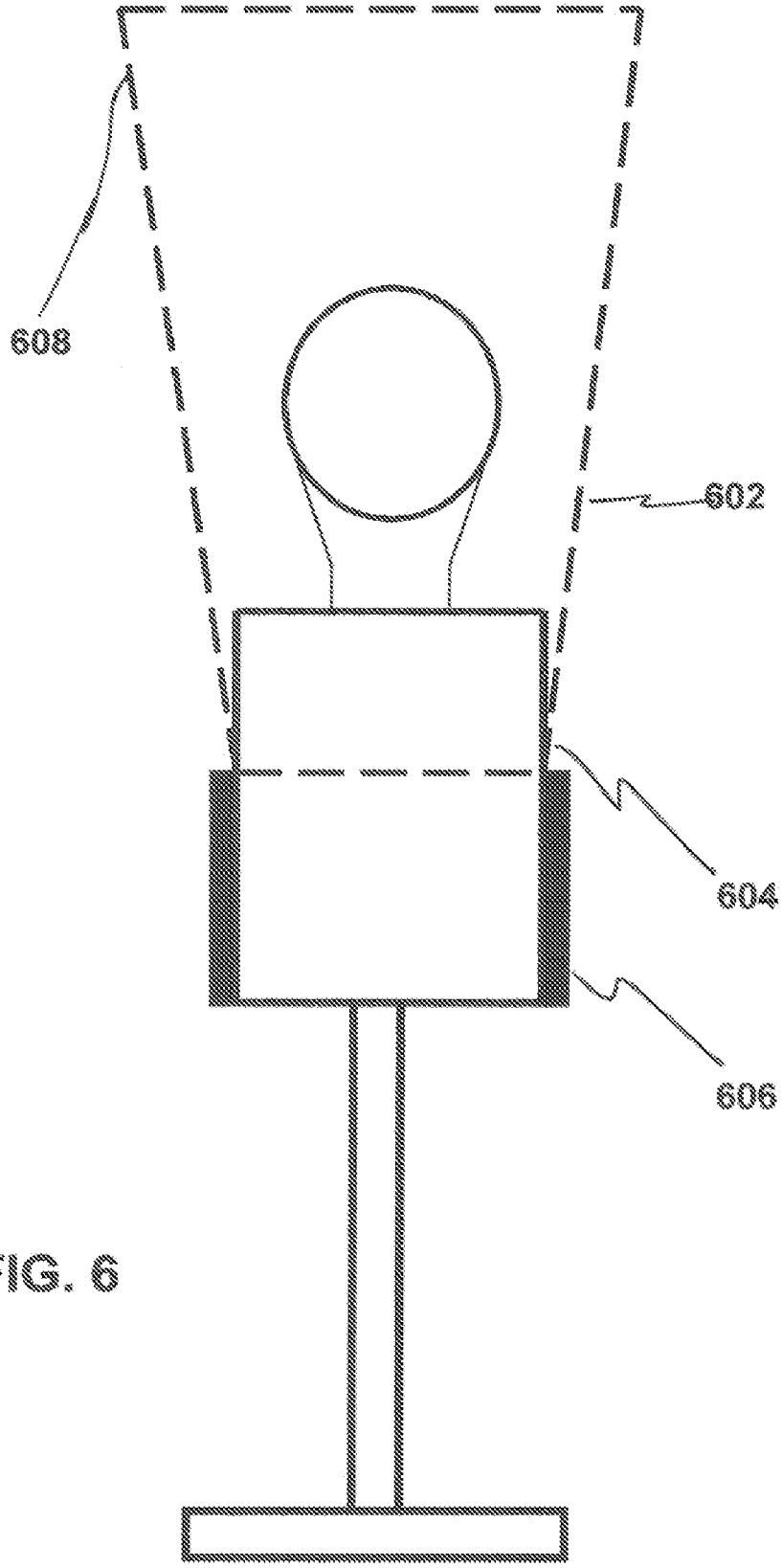
FIG. 6 is a view of the device of the present invention positioned on a lamp and serving as a lamp stand.

FIG. 6 is a view of the device of the present invention positioned on a lamp and serving as a lamp stand. In this embodiment, the device 602 is positioned on the lamp 606 with the smaller opening 604 engaging the lamp. Light illuminating from the lamp is channeled through the larger device opening 608. In addition, light from the lamp can also illuminate display information contained in the transparent compartments or information that is displayed on the lamp surface. Even when the lamp is turned off and is not illuminating light, the device of the present invention mounted on the lamp stand serves as a display of the information contained on the device.

In an alternate embodiment, the device of the present invention is positioned on a lamp and serving as a lamp stand. In this embodiment, the device is positioned on the lamp with the larger opening engaging the lamp. This position is opposite the position of FIG. 6. Light illuminating from the lamp is channeled through the smaller device opening and the larger device opening. In addition, light from the lamp can also illuminate display information contained in the transparent compartments or information that is displayed on the lamp surface. Even when the lamp is turned off and is not illuminating light, the device of the present invention mounted on the lamp stand serves as a display of the information contained on the device.

In another embodiment of the invention, the sheet material can be comprised of a flexible and bendable material. As with the previous embodiments, the front end of the material is smaller than the back end. The front end will form a smaller opening through the person will yell. The back end is longer than the front end. The front end should be of a length such that when present invention is positioned on a user's arm, the front end is positioned in the area of the user's wrist. Similar to other embodiments there are two side edges. These edges can also contain strips that secure these ends together to form the megaphone shape of the present invention. These strips can be magnetic strips or they can be of some other adhesive material such as the material supplied by Velcro™. The width of the strips can vary to provide the ability to adjust the device on the user's arm or leg. The material of the present convention has a rigid character. When the material is molded into a cone shape of the present invention, this material is resilient will retain or resume that shape. The edges come together, but are not permanently attached.

Referring to FIG. 2 shown is an open configuration of the invention with a transparent compartment 202. The transparent compartment 202 is formed across a surface of the device. In this embodiment, because it has reversible sides, either side of the device can be the outer side with the capability to display information and can have a transparent compartment formed across either or both surfaces of the material of the device.

The method of this invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. A device for projecting sound from a person into the atmosphere comprising:

a sheet of generally rigid material having a surface with opposite ends; said sheet material having a front end and a back end, both end having different lengths, said back end having a length longer than the length of said front end; said sheet material having pair of side edges at each end of said front and back ends the edges, said generally rigid sheet material being configured such that when said side edges come together, said sheet of generally rigid material forms a tapered and general cone shape having an outer surface and an inner, said generally rigid material being capable of maintaining the general cone shape, being capable of expanding the cone shape at the edges to create an opening in the cone shape when pressure is applied to the edges in opposite directions to force the edges apart and capable reconfiguring to the original cone shape without external assistance aiding such reconfiguring when pressure on the edges is reduced; and information being displayed on the outer surface of said rigid material when said rigid material is formed into a general cone shape.

2. The device as described in claim 1 further comprising on the edges magnetic strips such that magnetic forces from the strips attract to each other and further secure the general cone shape of the material.

3. The device as described in claim 1 further comprising a transparent sheet material attached to outer surface of the device such that a pocket is formed between the transparent sheet material and the outer surface of the sheet material, the pocket capable of containing information for display on the surface of said sheet material.

4. The device as described in claim 1 further comprising a lining attached to the inner surface of said generally cone shape material, said lining capable of providing insulation against low temperatures.

5. The device as described in claim 1 wherein said front and back ends can be used to channel light through the device.

6. The device as described in claim 1 wherein said front end has a length such that an inner circumference of the front end will securely fit around a user's wrist area.

7. The device as described in claim 6 wherein said front end has a length in the range of 9 inches to 13 inches.

8. The device as described in claim 1 wherein said front end has a length such that an inner circumference of the front end will securely fit around a user's ankle area.

9. The device as described in claim 8 wherein said front end has a length in the range of 10 inches to 14 inches.

10. A device for projecting sound from a person into the atmosphere comprising:

a sheet of generally rigid material having surface with opposite ends; said sheet material having a front end and a back end, both end having different lengths, said front end having a length in the range of 9 inches to 14 inches said back end having a length longer than the length of said front end, said back end having a length in the range of 13 inches to 20 inches; said sheet material having pair of side edges at each end of said front and back ends each said edge forming a tapered shape when the edges come together, said generally rigid sheet material being configured such that when said side edges come together, said sheet of generally rigid material forming a general cone shape having an outer surface and an inner, said generally rigid material being capable of maintaining the general cone shape, being capable of expanding the cone shape at the edges to create an opening in the cone shape when pressure is applied to the edges in opposite directions to force the edges apart and capable reconfiguring to the general cone shape without external assistance aiding such reconfiguring when pressure on the edges is reduced; and information being displayed on the outer surface of said rigid material when said rigid material is formed into a general cone shape.

11. A device for projecting sound from a person into the atmosphere comprising:

A sheet of flexible, bendable material, capable of reconfiguration without external assistance aiding such reconfiguration, having a surface with opposite sides; said sheet material having a front edge and a back edge, each edge having opposite ends, both edges having different lengths, said back edge having a length longer than the length of the front edge; said sheet material having a pair of side edges at each end of said front and back edges;

An adhesive material attached to each side edge of said sheet material; and

A transparent sheet material attached to said flexible sheet material such that a pocket is formed between the transparent sheet material and said flexible sheet material, the pocket capable of containing information for display on the surface of said sheet material; and Information displayed on the surface of said sheet material.

12. The device as described in claim 11 further comprising transparent sheets on both sides of the flexible sheet material.

13. The device as described in claim 11 wherein said adhesive material comprises a magnetic material.

14. The device as described in claim 11 wherein said adhesive material has a width that can vary enabling a user to adjust the device.

* * * * *